US007676166B2

(12) United States Patent
Saida et al.

(10) Patent No.: US 7,676,166 B2
(45) Date of Patent: Mar. 9, 2010

(54) IMAGE FORMING APPARATUS

(75) Inventors: Tadaaki Saida, Kashiwa (JP); Akihito Mori, Toride (JP); Nobuo Sekiguchi, Moriya (JP); Keita Takahashi, Abiko (JP)

(73) Assignee: Canon Kabushiki Kaisha (JP)

( * ) Notice: Subject to any disclaimer, the term of this patent is extended or adjusted under 35 U.S.C. 154(b) by 230 days.

(21) Appl. No.: 11/775,371

(22) Filed: Jul. 10, 2007

(65) Prior Publication Data

US 2008/0008486 A1 Jan. 10, 2008

(30) Foreign Application Priority Data

Jul. 10, 2006 (JP) ..... 2006-189620

(51) Int. Cl.
*G03G 15/00* (2006.01)

(52) U.S. Cl. ..... 399/49; 399/74

(58) Field of Classification Search ..... 399/49, 399/74; 250/559.1

See application file for complete search history.

(56) References Cited

U.S. PATENT DOCUMENTS 3,970,393 A * 7/1976 Krygeris et al. ..... 356/425
5,740,495 A * 4/1998 Maher et al. ..... 399/71
5,778,280 A * 7/1998 Komiya et al. ..... 399/49
7,382,993 B2 * 6/2008 Mongeon et al. ..... 399/49
2003/0091357 A1 * 5/2003 Maebashi et al. ..... 399/49
2005/0147424 A1 * 7/2005 Kato et al. ..... 399/49
2006/0238778 A1 * 10/2006 Mongeon et al. ..... 358/1.4

FOREIGN PATENT DOCUMENTS

JP 2002-196548 A 7/2002

* cited by examiner

*Primary Examiner*—David M Gray
*Assistant Examiner*—Rodney Bonnette
(74) *Attorney, Agent, or Firm*—Rossi, Kimms & McDowell LLP

(57) ABSTRACT

An image forming apparatus that can provide a quality image in a stable manner without lowering the productivity. A reference image forming unit forms reference images on a transfer member. A plurality of sensing units detect densities of the formed reference images. A control unit adjusts respective output values from the plurality of sensing units according to a difference between the output values from the plurality of sensing units. The control unit performs error processing according to the difference between the output values from the plurality of sensing units when the control unit adjusts the output values from the plurality of sensing units.

3 Claims, 7 Drawing Sheets

IMAGE FORMING APPARATUS

BACKGROUND OF THE INVENTION

1. Field of the Invention

The present invention relates to an image forming apparatus, and more particularly, to an image forming apparatus that has a plurality of density sensing units arranged in the main scanning direction so as to be able to read a plurality of test patches for correcting density sensing output that are arranged in the main scanning direction at the same time.

2. Description of the Related Art

A configuration for forming a test patch (reference image) for adjustment of the apparatus, reading the test patch and correcting an image based on the read result (color registration control, density control (Dmax control, Dhalf control)) has been proposed for an image forming apparatus. With the configuration, however, the test patch is formed and read, with the usual image forming operation retarded or suspended, when the image forming apparatus is powered on, when the process devices are exchanged, or when a predetermined number of images has been formed, for example. That lowers the productivity of image forming.

Then, there are disposed a plurality of density sensors (sensing unit) in the main scanning direction which is along a longitudinal direction of an image carrier on which the image is formed, that is, a direction perpendicular to a conveying direction of the image carrier. A technique using a plurality of the density sensors to read the test patches in parallel has been proposed (for example, see Japanese Laid-Open Patent Publication (Kokai) No. 2002-196548).

When a plurality of density sensors read test patches, it is desirable to adjust sensitivity characteristics of respective density sensors almost the same. However, as the sensitivity characteristics of the density sensors may vary according to the temperature, the water content and the like, or may vary according to changes with time and in durability, the sensitivity characteristics of density sensors cannot be kept almost the same. Accordingly, it is impossible to perform correct control over the densities. That makes it difficult to supply a quality image in a stable manner.

SUMMARY OF THE INVENTION

The present invention provides an image forming apparatus that can provide a quality image in a stable manner without lowering the productivity.

In a first aspect of the present invention, there is provided an image forming apparatus comprising: an image carrier; a first sensing unit disposed opposite to the image carrier at a first position; a second sensing unit disposed opposite to the image carrier at a second position different from the first position; and a control unit adapted to adjust an output of the second sensing unit based on a level difference between an output of the first sensing unit and the second sensing unit when the first sensing unit and the sensing unit sense a reference image formed on the image carrier, respectively.

In a second aspect of the present invention, there is provided an image forming apparatus comprising: a reference image forming unit adapted to form reference images on an image carrier; a plurality of sensing units adapted to detect densities of the formed reference images; and a control unit adapted to adjust respective output values from the plurality of sensing units according to a difference between the output values from the plurality of sensing units, wherein the control unit is adapted to perform error processing according to the difference between the output values from the plurality of sensing units when the control unit adjusts the output values from the plurality of sensing units.

The error processing can include detecting a failure of each of the sensing units and performing an error report.

The image forming apparatus can further comprises: a developing unit adapted to contain a developing solution and supply the developing solution to the reference image forming unit; and a stirring unit adapted to stir the developing solution in the developing unit. The control unit can cause the stirring unit to stir the developing solution in the developing unit, and then cause the reference image forming unit to form the reference images, and further detect a failure of each of the sensing units according to a difference between the output values from the plurality of sensing units for the formed reference images to thereby perform the error report.

The plurality of sensing units can include two of the sensing units, and the control unit can calculate a difference between an output value from one of the sensing units and an output value from the other of the sensing units, and perform the error processing if the calculated difference exceeds a predetermined value.

The image forming apparatus can further comprises: a corrected value setting unit adapted to set a corrected value for correcting the output value from the one of the sensing units according to the difference, when the calculated difference is at the predetermined value or less.

The control unit can cause the reference image forming unit to form the reference images when the control unit adjusts the output values from the plurality of sensing units.

According to the present invention, a quality image can be provided in a stable manner without the productivity lowered.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the accompanying drawings showing preferred embodiment thereof.

Figure 1:
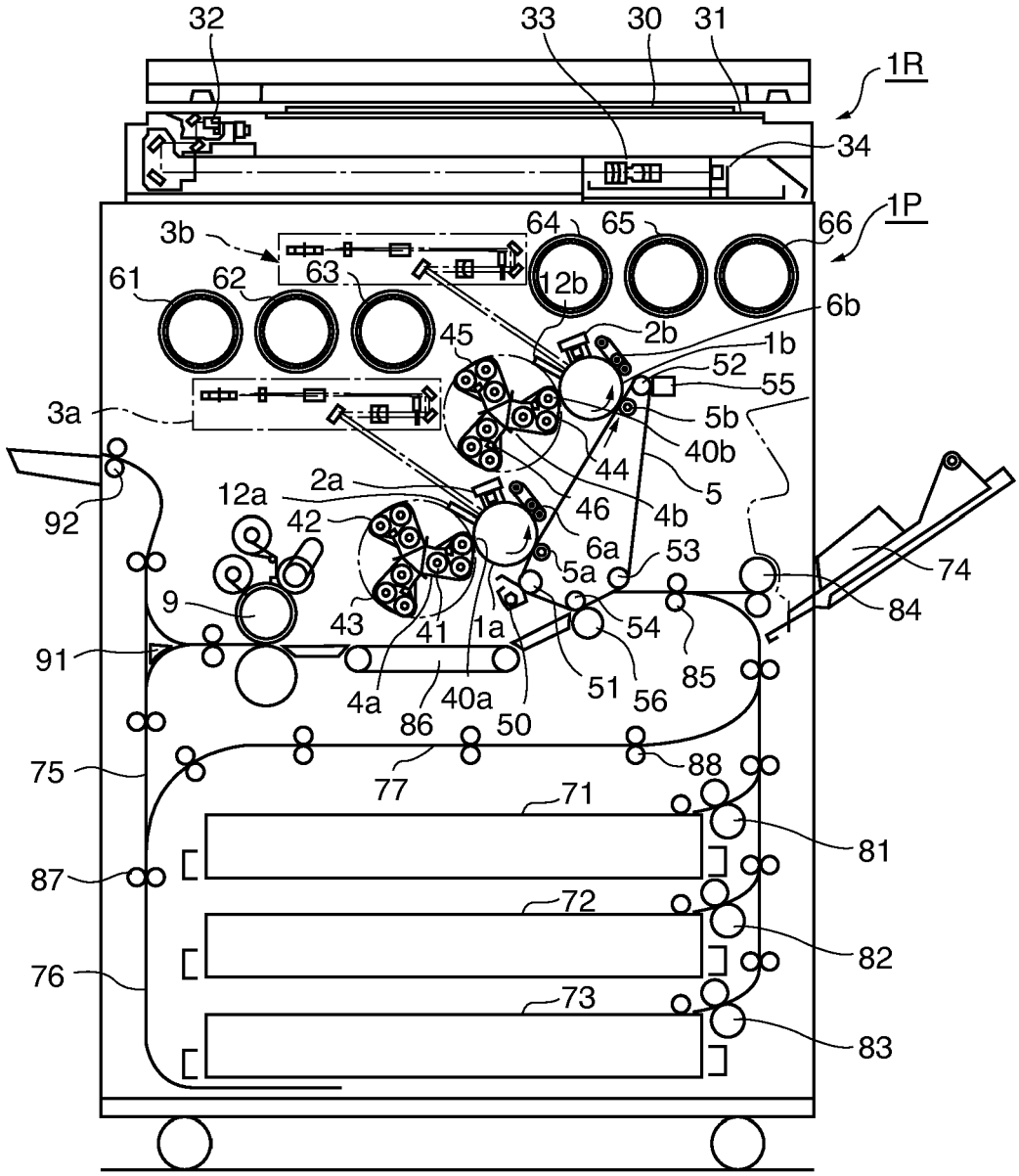
FIG. 1 is a vertical cross-sectional view showing a configuration of an image forming apparatus according to a first embodiment of the present invention.

FIG. 1 is a vertical cross-sectional view showing a configuration of an image forming apparatus according to a first embodiment of the present invention. In the embodiment, a full-color image forming apparatus will be described.

As shown in FIG. 1, the full-color image forming apparatus has a reader unit 1R that can read a color image and a printer unit 1P that can output a print of a color image.

The reader unit 1R performs exposure scanning on a manuscript 30 placed on a sheet of manuscript table glass 31 by using an exposure lamp 32, and forms an image of a reflected light from the manuscript 30 on a full-color CCD sensor (hereinafter referred to as "the CCD") 34 by using a lens 33. The CCD 34 converts the formed light figure into R, G, B signals and output them. The output R, G, B signals are subjected to predetermined image processing in an image processing unit and then sent out to the printer unit 1P via an image memory (not shown).

Into the printer unit 1P, an image signal from a computer, an image signal from a facsimile machine are also input as well as the signal from the reader unit 1R. The embodiment will be descried assuming that the signal from the reader unit 1R is input into the printer unit 1P as an example.

The printer unit 1P has two photosensitive drums 1*a* and 1*b*, which are image supporting bodies. Each of the photosensitive drums 1*a* and 1*b* is rotatably driven in the direction of the arrow in the figure. Around the photosensitive drums 1*a* and 1*b*, preexposure lamps 11*a* and 11*b*, corona primary electrostatic chargers 2*a* and 2*b*, exposing units 3*a* and 3*b*, and electric potential sensors 12*a* and 12*b* are placed, respectively. Around the photosensitive drums 1*a* and 1*b*, rotaries 4*a* and 4*b*, primary transfer devices 5*a* and 5*b* and cleaning devices 6*a* and 6*b* are placed, respectively.

The rotary 4*a* has three developing devices 41, 42 and 43 for supplying toner with different colors mounted. The rotary 4*b* has three developing devices 44, 45 and 46 for supplying toner with different colors mounted. Each of the developing devices 41 to 46 can supply six colors of toner in total; magenta (M), cyan (C), yellow (Y), black (K), light magenta (light M) with lowered opacifying strength of the basic color, light cyan (light C) to the photosensitive drums 1*a* and 1*b*. That is, it can form a color image with four colors of toner; magenta (M), cyan (C), yellow (Y), and black (K) or a color image with six colors of toner of the four colors and further light magenta (light M) and light cyan (light C). To each of the developing devices 41 to 46, toner with a corresponding color is supplied from each of corresponding toner containers (hopper) 61 to 66 as required. The toner is supplied from each of the toner containers 61 to 66 at a desired time so as to keep the ratio of toner (the amount of toner) in each of the developing devices 41 to 46.

The toner used in the embodiment is what makes the deposit on a sheet of white paper around 0.5 mg/cm$^2$ with the saturated density for toner of magenta (M), cyan (C), yellow (Y), black (K) around 1.4. The amount of pigment in the toner is made less than that in usual cyan toner or magenta toner so that toner of the light magenta (light M) and the light cyan (light C) has the density obtained at the time when 0.5 mg/cm$^2$, the same amount of the other colored toner, of toner of light magenta (light M) and light cyan (light C) is deposited on a sheet of white paper is around 0.7 to 0.8.

A pixel (dot) formed by light colored toner, the light C, for example, does not stand out from a pixel formed by the cyan toner, as the light colored toner has low density. Therefore, by using light colored toner, high quality of a quite smooth halftone image without granularity can be reproduced. Here, the light cyan toner and the light magenta toner are types of toner with the same pigments as those of cyan and magenta, differing only in the amount of the contained pigments. As those types of toner, a developing solution with two components in which toner and carrier are mixed may be used or a developing solution with one component of toner may be used.

The exposing units 3*a* and 3*b* modulate a laser beam based on an image signal for each color of Y, M, C, K converted from each signal from the reader unit 1R in the image processing unit 203 (FIG. 2) (or the light M, the light C added to them). The modulated laser beam is applied to the surface of each of the rotary driven photosensitive drums 1*a* and 1*b* through a lens and a reflecting mirror, as it is scanned by a polygon mirror. Accordingly, the surface of each of the photosensitive drums 1*a* and 1*b* is exposed so that an electrostatic latent image is formed in a corresponding color. As processing prior to exposure on the photosensitive drums 1*a* and 1*b*, removal of electricity by the preexposure lamps 11*a* and 11*b* and electrostatic charge by the corona primary electrostatic chargers 2*a* and 2*b* are performed.

Next, the rotaries 4*a* and 4*b* are rotated and the corresponding developing devices are moved to developing places for the photosensitive drums 1*a* and 1*b*. Then, toner is supplied from the developing devices moved to the developing places to the photosensitive drums 1*a* and 1*b*, and the electrostatic latent image on the photosensitive drums 1*a* and 1*b* is visualized as a toner image.

Here, the distances from the exposing units 3*a* and 3*b* to the developing places of the respective developing devices 41 to 46 are identical with one another. That is, as the distances are constant, a difference in output image characteristics due to color is difficult to occur without regard of color.

The toner image formed on the photosensitive drums 1*a* and 1*b* are transferred as superimposed on an intermediate transfer belt 5 by the corresponding primary transfer devices 5*a* and 5*b* (primary transfer), respectively. The intermediate transfer belt 5 is put over a driving roller 51, a driven roller 52, and a plurality of rollers 53 and 54, and driven by the driving roller 51. A transfer cleaning device 50 is placed so as to face the driving roller 51 across the intermediate transfer belt 5. The transfer cleaning device 50 has a cleaning blade that can contact with and separate from the intermediate transfer belt 5. After the toner image superimposed and transferred on the intermediate transfer belt 5 is transferred on a sheet of paper (secondary transfer), the transfer cleaning device 50 brings the cleaning blade to contact with the intermediate transfer belt 5 to clean the remaining toner on the intermediate transfer belt 5.

Two density sensing sensors 55 (first sensing unit, second sensing unit) (only one of which is shown) are arranged to face the driven roller 52 across the intermediate transfer belt 5 (image carrier). Each of the density sensing sensors 55 is a sensor for sensing misalignment of the toner image transferred on the intermediate transfer belt 5 and its density. Each of the density sensing sensors 55 is placed in cross-direction of the intermediate transfer belt 5. An output from each of the density sensing sensors 55 is used for correcting the image density, the supply amount of toner, the time for writing an image, and the start place for writing an image.

The sheet of paper to which the toner image is transferred is carried from each of storage units 71, 72 and 73 or a manual paper feeder 74 to a registration roller 85 via each of paper feeders 81, 82 and 83 or a paper feeder 84 sheet by sheet. The registration roller 85 corrects oblique passage of the sheet of paper and sends it out to a secondary transfer unit 56 at a time to start image forming. To the sheet of paper sent to the secondary transfer unit 56, the secondary transfer unit 56 transfers a toner image supported on the intermediate transfer belt 5 (secondary transfer).

The sheet of paper, on which the toner image is transferred, is sent to a fixing device 9 through a conveying unit 86. In the fixing device 9, the toner image on the sheet of paper is heated and pressed to be fixed on the sheet of paper. The sheet of paper on which the toner image is fixed is led to a discharging roller 92 side or a conveying path 75 side by a conveying path guide 91. The sheet of paper led to the discharging roller 92 is carried to a discharging tray or a post-processing device by the discharging roller 92.

A sheet of paper is led to the conveying path 75 by the conveying path guide 91 when an image is formed on both sides of the sheet. The sheet led to the conveying path 75 is once sent to a reverse path 76 and leaves the reverse path 76 in the direction reverse to such a direction as that the sheet is sent into the reverse path 76, as the reverse roller 87 reverses the sheet with the rear end as the top. Accordingly, the sheet is reversed so that the image forming side of the sheet is changed from the right side to the backside. Then, the sheet is sent to a both side conveying path 77, subjected to the correction on the oblique passage by both side conveying rollers 88, and then, carried toward the registration rollers 85 at a corresponding timing. Thus, the toner image is transferred on the backside of the sheet.

Now, an image forming mode of the embodiment will be described.

In the embodiment, there are three modes such as a BW mode (monochrome image mode), a 4 C mode (usual image quality mode) using four colors of yellow (Y), magenta (M), cyan (C) and black (K), and a 6 C mode (high image quality mode) using six colors of Y, M, C, K, light M and light C.

First, the 4 C mode using Y, M, C, K will be described. In this mode, a toner image is formed in the order of M, C, Y, and K. Specifically, an electrostatic latent image in M is formed on the photosensitive drum 1*a* first, and the electrostatic latent image is visualized as a toner image in M by the developing device 41. The toner image in M is transferred on the intermediate transfer belt 5. An electrostatic latent image in C is formed on the photosensitive drum 1*b*, and the electrostatic latent image is visualized as a toner image in C by the developing device 44. The toner image in C is superimposed on the magenta toner image and transferred on the intermediate transfer belt 5.

Next, an electrostatic latent image in Y is formed on the photosensitive drum 1*a*, and the electrostatic latent image is visualized as a toner image in Y by the developing device 42. The toner image in Y is superimposed on the toner image in M and transferred on the intermediate transfer belt 5. An electrostatic latent image in K is formed on the photosensitive drum 1*b* and the electrostatic image is visualized as a toner image in K by the developing device 45. The toner image in K is superimposed on the toner image in Y and transferred on the intermediate transfer belt 5.

The toner images in M, C, Y and K are formed as the intermediate transfer belt 5 turns twice and superimposed in order. In this manner, a full-color toner image is formed on the intermediate transfer belt 5 and transferred on the sheet of paper (secondary transfer).

In the BW mode, an electrostatic latent image in K is formed on the photosensitive drum 1*b* and the electrostatic latent image is visualized as a toner image in K by the developing device 45. Then, the toner image in K is transferred on the intermediate transfer belt 5. Here, as the developing device 45 for K is placed in the downstream of the photosensitive drum 1*b*, a first copy time period (Fcot) can be reduced by the time for the intermediate transfer belt 5 to move the distance between the photosensitive drums 1*a* and 1*b*. Degradation of the image quality by the secondary transfer, which is resulted as the toner image in K that is subjected to the primary transfer on the intermediate transfer belt 5 passes a nip unit between the photosensitive drum 1*a* and the intermediate transfer belt 5, can also be eliminated.

In the 6 C mode (high image quality mode) using six colors of M, C, Y, K, light C and light M, toner images in four colors of M, C, Y and K are formed and transferred on the intermediate transfer belt 5 in order as in the above-mentioned 4 C mode. Then, an electrostatic latent image in light C is formed on the photosensitive drum 1*a*, and the electrostatic latent image is visualized as a toner image in light C by the developing device 43. The toner image in light C is superimposed on the toner image in K and transferred on the intermediate transfer belt 5. An electrostatic latent image in light M is formed on the photosensitive drum 1*b*, and the electrostatic latent image is visualized as a toner image in light M by the developing device 46. The toner image in light M is superimposed on the toner image in light C and transferred on the intermediate transfer belt 5. Accordingly, all the toner images for six colors are transferred on the intermediate transfer belt 5. That is, the secondary transfer is achieved to provide a six colored image with a high image quality without granularity, while the intermediate transfer belt 5 turns three times.

Figure 2:
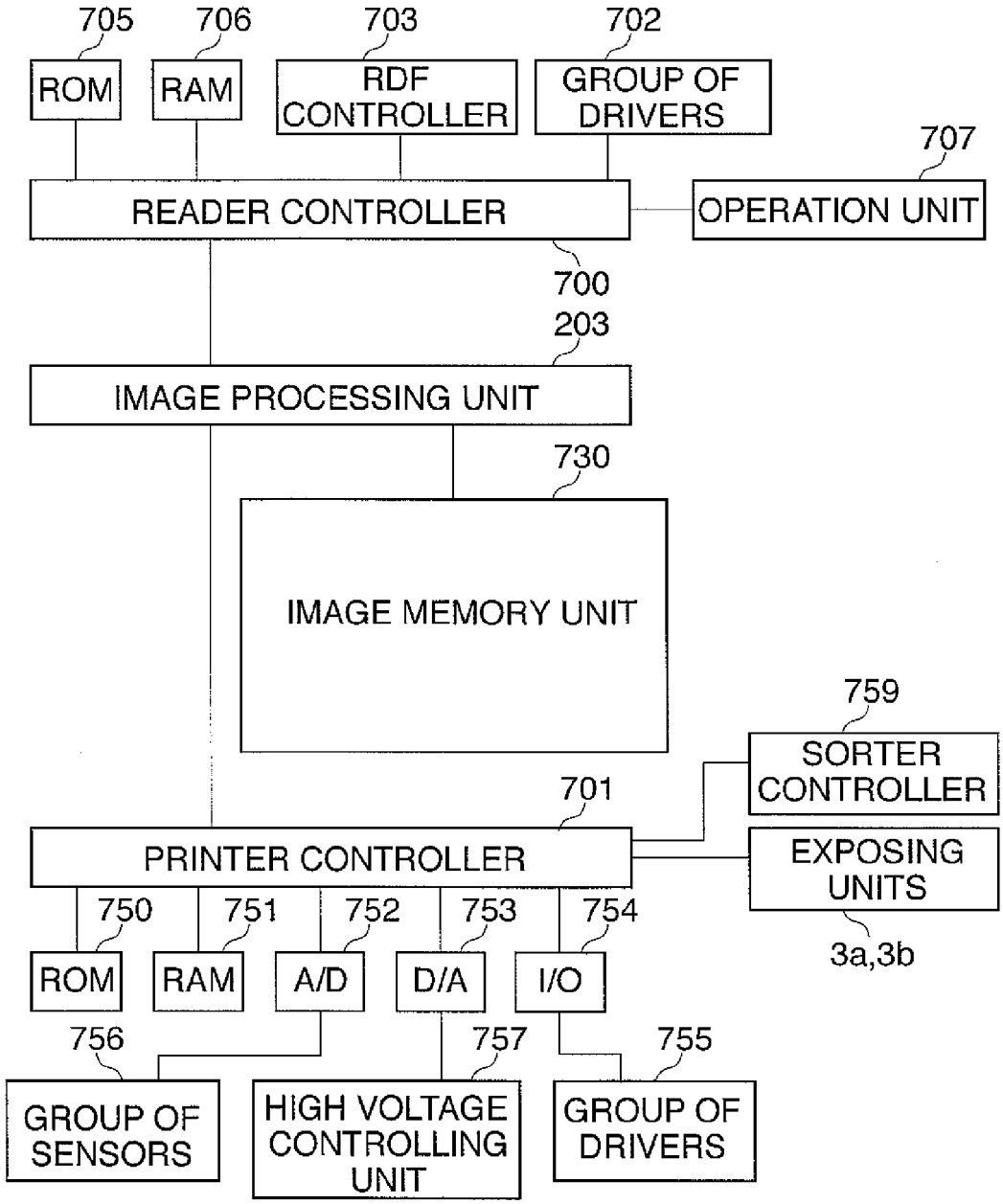
FIG. 2 is a block diagram showing a configuration of a controlling system of the full-color image forming apparatus in FIG. 1.

Now, a controlling system of the full-color image forming apparatus in the embodiment will be described with reference to FIG. 2. FIG. 2 is a block diagram showing a configuration of a controlling system of the full-color image forming apparatus in FIG. 1.

As shown in FIG. 2, the controlling system of the full-color image forming apparatus includes a reader controller 700 for controlling the reader unit 1R and the image processing unit 203, and a printer controller 701 for controlling the printer unit 1P.

The reader controller 700 includes a CPU (not shown). The CPU performs respective types of controlling for controlling the reader unit 1R, the image processing unit 203 and the printer unit 1P according to the program stored in a ROM 705. As a work area for the reader controller 700 to perform controlling, a RAM 706 is used. Specifically, the reader controller 700 sets an image forming mode (for example, a monochrome image forming mode, a color image forming mode and the like) and implementation conditions (for example, the number of copies, a density value and the like) according to input from an operation unit 707. Then, the reader controller 700 controls a group of drivers 702 and an RDF controller 703 in the reader unit 1R according to the set mode and its implementation. The reader controller 700 sends an operational instruction according to the set mode and its implementation to the printer controller 701.

Here, the group of drives 702 includes a plurality of drivers such as a motor driver for driving an optical motor that moves the exposure lamp 32 and the like, a CCD driver for driving the CCD 34 and a driver for driving the exposure lamp 32. The above-mentioned RFD controller 703 is a controller for controlling an operation of an automatic manuscript feeding device that automatically feeds manuscript. The automatic manuscript feeding device is an optional device that can be mounted to the reader unit 1R as required.

The reader controller 700 controls an operation of the image processing unit 203. The image processing unit 203 converts each of analog signals of R, G and B input from the CCD 34 of the reader unit 1R into each of digital signals of R, G and B. Then, each of the digital signals of R, G and B is converted into an image signal for each color (four colors of M, C, Y, and K or six colors including light M and light C added to the four colors) and the converted image signals are output. A black region of an image is extracted from an image signal in each of M, C and Y, and an image signal in K (black) for the extracted black region is output. The image signal in each color is once stored in an image memory unit 730 and then output to the printer controller 701. The image processing unit 203 has an ACS function (automatic color mode selecting function) for determining whether an input image is a full-color image or a monochrome image based on the extracted black region.

The printer controller 701 includes a CPU (not shown). The CPU controls the printer unit 1P to perform an operation in response to an operational instruction from the reader controller 700 according to the program stored in the ROM 750. As a work area for the printer controller 701 to perform controlling, a RAM 751 is used. Specifically, the printer controller 701 controls a group of drivers 755 via an I/O 754 based on each signal output from a group of sensors 756 including various sensors via an A/D 752. The group of sensors 756 includes a sensor for sensing a fixing temperature of the fixing device 9, a sensor for sensing a primary transfer voltage and a secondary transfer voltage, a sensor for sensing an environmental temperature of a device, a sensor for sensing an environmental humidity and the above-mentioned density sensing sensor 55. The group of drivers 755 include various types of drivers for driving a load of each of a rotary developing device motor, a photosensitive drum motor, a clutch and the like.

The printer controller 701 generates a set value for a high voltage controlling unit 757 based on each signal from the above-mentioned group of sensors 756, and sets the set value to the high voltage controlling unit 757 via a D/A 753. The high voltage controlling unit 757 controls generation and application of a high voltage such as a developing bias and a transfer bias based on the set value that is set.

The printer controller 701 inputs each image signal from the image processing unit 203 and outputs the image signal to the exposing units 3*a* and 3*b*.

The printer controller 701 performs communication with a sorter controller 759 and instructs the sorter controller 759 on the post-processing mode for the post-processing device to implement. The sorter controller 759 controls the post-processing device to perform the processing according to the instructed post-processing mode, such as a non-sort processing, a sort processing, and a staple processing.

Figure 3:
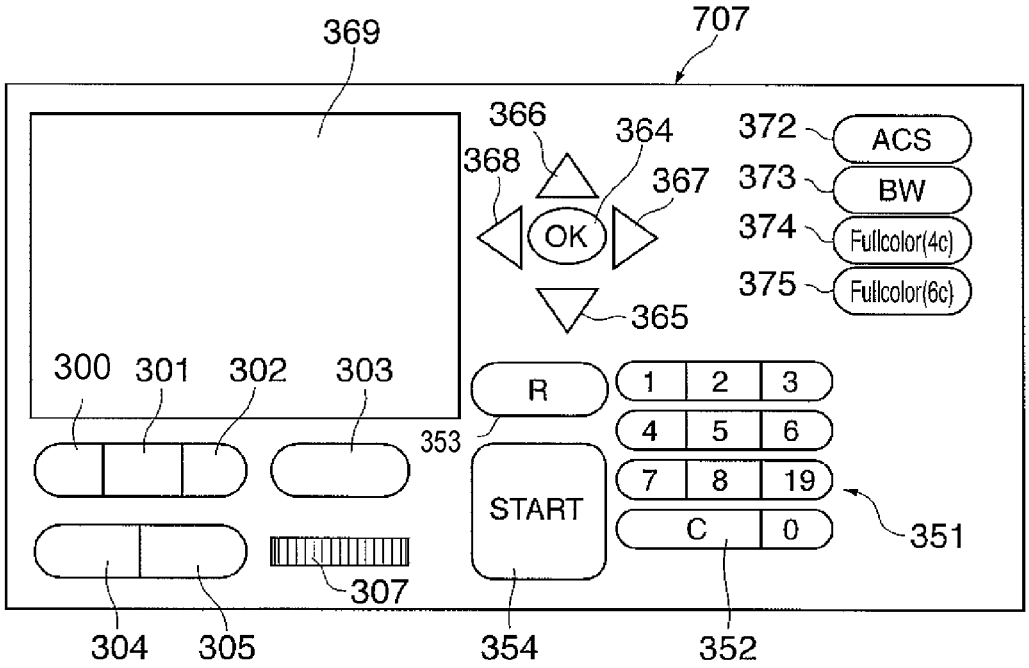
FIG. 3 is a plane view showing key arrangement on an operation unit in FIG. 2.

Now, the operation unit 707 will be described with reference to FIG. 3. FIG. 3 is a plane view showing key arrangement on the operation unit 707 in FIG. 2.

As shown in FIG. 3, the operation unit 707 is provided with a same size key 300, a magnification varying key 301, a sheet selection key 302, a density setting key 303, a sorter selection key 304 and a both side mode key 305. The density level set by the density setting key 303 is displayed on a density display bar 307. The operation unit 707 is provided with numeral keys 351, a clear-stop key 352, a reset key 353 and a start key 354.

The operation unit 707 is provided with a display unit 369 including a liquid crystal display panel. The display unit 369 displays a setting screen for a user to set details for a mode. With cursor operation on the setting screen, a desired setting item is selected. A user operates the cursor by using cursor keys 365 to 368 for moving the cursor upward, downward, leftward and rightward. In order to select an item instructed by the cursor, the user presses an OK key 364 so that the selected item is set.

The operation unit 707 is provided with an ASC key 372, a BW key 373, a full-color key 374 and a full-color key 375. The ASC key 372 is a key for setting to automatically select any of the BW mode (monochrome image mode), the 4 C mode using four colors of Y, M, C and K (usual image quality mode) and the 6 C mode using six colors of Y, M, C, K, light M and light C (high image quality mode). The BW key 373 is a key for setting the BW mode. The full-color key 374 is a key for setting the 4 C mode, and the full-color key 375 is a key for setting the 6 C mode.

Here, only typical keys set in the operation unit 707 are shown but the present invention is not limited thereto.

In the embodiment, correction control on the supply amount of toner, control on the maximum density, control on intermediate density correction (Dhalf) for correcting the linearity of development, and control on output correction of each of the density sensing sensors 55 are performed and images of test patches for controlling them is created. For creating the test patches, toner images as the corresponding test patches are formed on each of the photosensitive drums 1*a* and 1*b* and transferred on the intermediate transfer belt 5. The toner images transferred on the intermediate transfer belt 5 are read by the respective density sensing sensors 55. After the toner images, which are test patches on the intermediate transfer belt 5, are read, the toner images are scratched by the transfer cleaning device 50 and collected without being transferred on a sheet of paper. The toner images on the photosensitive drums 1*a* and 1*b* are also scratched and collected.

Then, correction control on the supply amount of toner, control on the maximum density, control on intermediate density correction (Dhalf), and control on output correction of the respective density sensing sensors 55 are performed based on the output from each of the density sensing sensors 55 (first sensing unit, second sensing unit). The control manners thereof will be detailed later.

Figure 4:
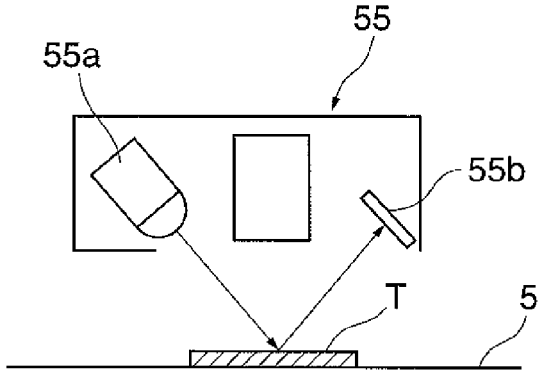
FIG. 4 is a vertical cross-sectional view schematically showing a configuration of each density sensing sensor in FIG. 1.
Figure 5:
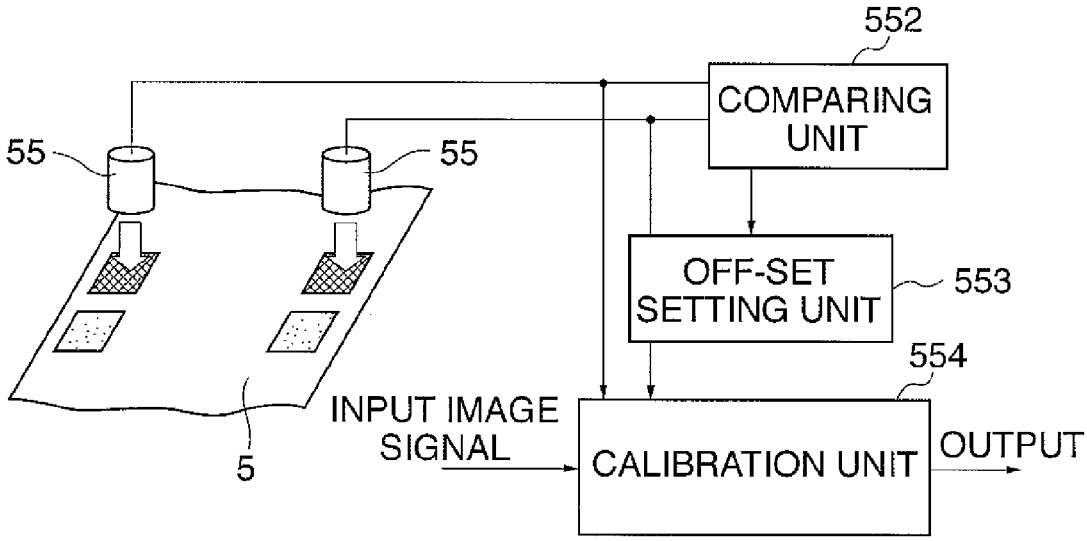
FIG. 5 is a diagram schematically showing arrangement of each density sensing sensor in FIG. 1 and a circuit configuration for processing output therefrom.

Now, a configuration of, arrangement of and a circuit configuration for processing output from each of the density sensing sensors 55 will be described with reference to FIG. 4 and FIG. 5. FIG. 4 is a vertical cross-sectional view schematically showing a configuration of each of the density sensing sensors 55 in FIG. 1. FIG. 5 is a diagram schematically showing arrangement of and a circuit configuration for processing outputs from the respective density sensing sensors 55 in FIG. 1.

As shown in FIG. 4, each of density sensing sensor 55 includes a light-emitting unit 55*a* including a LED and a photoreceptor unit 55*b* including a photo-sensor. The light-emitting unit 55*a* is adapted to radiate a light toward the surface of the intermediate transfer belt 5 or a test patch T on the surface, and the photoreceptor unit 55*b* is adapted to receive a reflected light from the surface of the intermediate transfer belt 5 or the test patch T. The amount of light emitted from the light-emitting unit 55*a* is adjusted so that the output from the photoreceptor unit 55*b* is a target output value when a ground of the intermediate transfer belt 5 is read.

As shown in FIG. 5, the respective density sensing sensor 55 are arranged in the width direction (in the main scanning direction) of the intermediate transfer belt 5 (image carrier) so as to be spaced from each other. When the corresponding test patches (reference image) pass the respective density sensing sensors 55, the respective density sensing sensor 55 read the test patches to output the results. The output from each of the density sensing sensors 55 is converted into a digital signal by the A/D 752 (FIG. 2) and then input into the image processing unit 203 via the printer controller 701. The A/D 752 and the printer controller 701 are omitted in FIG. 5.

The image processing unit 203 includes a comparing unit 552, an off-set setting unit 553 and a calibration unit 554. The comparing unit 552 captures output values from the respective density sensing sensors 55 when the output values from the density sensing sensor 55 are corrected, and calculates a difference between one of the captured output values and the other of the captured output values. Then, the comparing unit 552 determines whether or not the calculated difference exceeds a predetermined value. If the calculated difference does not exceed the predetermined value, that calculated difference is input into the off-set setting unit 553.

The off-set setting unit 553 calculates the off-set value for the output value from one of the density sensing sensors 55 based on the input difference and sets the value. Accordingly, the output value from one of the density sensing sensors 55 is corrected with the set off-set value, and then input into the calibration unit 554. In contrast, if it determined that the difference exceeds the predetermined value, the printer controller 701 determines that any one of the density sensing sensors 55 has broken down and reports the reader controller 700 as such. The reader controller 700 that receives the report causes the display unit 369 of the operation unit 707 to display that any one of the density sensing sensors 55 has broken down as an error processing and instructs the entire device to stop.

The calibration unit 554 creates a correction table (γ table) for matching the linearity of the image signal and the linearity of the density of the test patch that is read by each of the density sensing sensors 55 based on the output value from each of the density sensing sensors 55. The output value from one of the density sensing sensors 55 is an output value corrected with the set off-set value. Then, the calibration unit 554 performs density correction on the image signal based on the correction table.

Figure 6:
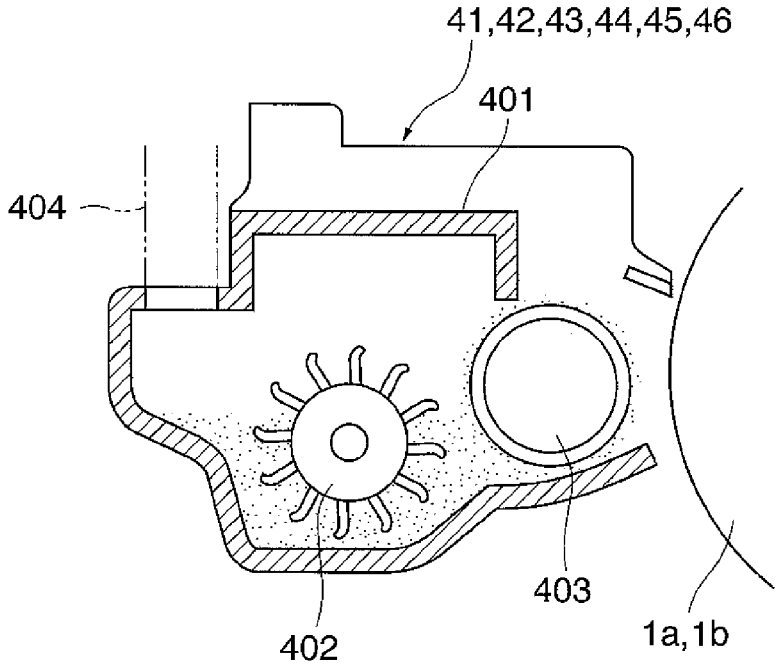
FIG. 6 is a vertical cross-sectional view schematically showing an inner configuration of developing devices in FIG. 1.

Now, an inner configuration of each of the developing devices 41 to 46 will be described with reference to FIG. 6. FIG. 6 is a vertical cross-sectional view schematically showing an inner configuration of the developing devices 41-46 in FIG. 1.

As shown in FIG. 6, each of the developing devices 41 to 46 has a body 401 for containing toner in a corresponding color inside. The body 401 is provided with a stirring roller 402 for stirring toner and a developing sleeve 403 therein. The developing sleeve 403 rotates while supporting toner to supply the toner to the photosensitive drums 1*a* and 1*b*. The body 401 is provided with a receiving port 404 for receiving toner supplied from a corresponding toner container.

Here, a sensor for sensing the amount of toner (or the remaining amount of toner) in each of the developing devices 41 to 46 is not provided. In the embodiment, the amount of toner consumption is calculated based on the number of video count of the printed image signals, and the consumption amount of toner is set as the supply amount of toner from each of the toner containers 61 to 64 to the developing devices 41 to 46. Each of the toner containers 61 to 64 is provided with a screw (not shown) for supplying toner. Assuming that the amount of toner at a time when the screw is turned for a unit time is G, a time for turning the screw is t, and the supply amount of toner is X, the supply amount of toner X is represented by the following expression.

$$X=G\cdot t$$

As the toner is uniformly supplied to the developing device when the toner is supplied, the supplying operation needs to be performed while the developing device is operating. If a time taken for supplying exceeds a developing time, the supplying operation is performed for twice of the developing operations.

The toner supplying operation based on the video count can keep almost correct amount of supply for a short period. If it is used for a long time, the amount of supply has an error so that the actually developed toner image may not be a toner image with the set density.

In the embodiment, when the number of prints reaches a predetermined number, a pair of the test patches arranged in the main scanning direction are formed, and the respective density sensing sensors 55 read the corresponding test patches. The supply amount of toner at a time of a toner supplying operation based on the video count hereafter is corrected based on the outputs from the respective density sensing sensors 55. A pair of the test patches for correcting the supply amount of toner are toner images formed corresponding to respective colors.

Figure 7:
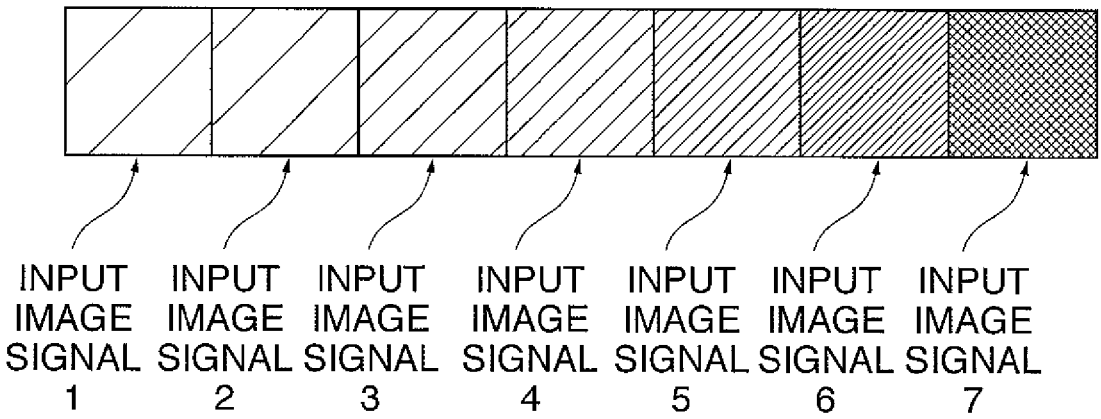
FIG. 7 is a diagram showing examples of test patches used in halftone density correction control.

Now, the halftone density correction control will be described with reference to FIG. 7. FIG. 7 is a diagram showing examples of test patches used in the halftone density correction control.

In the case of the halftone density correction control, a plurality of test patches for halftone density are formed corresponding to respective colors and the respective density sensing sensors 55 read the test patches. Accordingly, densities of the respective test patches are sensed, and a correction table for matching linearity of the image signals and linearity of densities of the measured test patches (γ table) is created based on the results of sensing the densities. As the plurality of test patches for halftone density, test patches corresponding to respective different input image signals S1 to S7 as shown in FIG. 7 are formed. The respective input image signals S1 to S7 are previously stored in the image memory unit 730.

When print output is performed, density correction is performed on the image signal based on the correction table, and the image signal corrected in density is output. Accordingly, an image with appropriate halftone colors can be provided.

An image of the test patch is usually created in various developing conditions. This is because developing characteristic by digital photograph always depends on the temperature, humidity and the like and the linearity is low in the characteristic. For example, test patches with various dither patterns are created in various developing conditions. If the purpose is commercial printing such as to sell printed material, correct color is required. Thus, an image of the test patch is frequently created and adjustment for sufficiently combining colors based on the density sensing result for the test patch is performed. The number of the test patches becomes as many as 200, when many test patches are created.

In the embodiment, as two density sensing sensors 55 are arranged in the main scanning direction as mentioned above, creation of an image of the test patch till the end of reading completes in a half time of that taken in a case where one density sensing sensor reads a test patch. Particularly, it is more useful when images of many test patches are created.

However, for the density sensing sensors 55, the output values may vary between the density sensing sensors due to dispersion of accuracy of their parts and accuracy of assembly. The output may also vary due to changes in an environment and durability and a change with time.

Therefore, the respective density sensing sensors 55 need to be adjusted so that their sensitivities are identical with each other. That is, the respective density sensing sensors 55 need to be adjusted so that their output values for the same test patch are identical with each other. This is because, unless the output values of the density sensing sensors 55 for the same test patch are identical with each other, the correction table created based on the respective output values is not correct.

In the embodiment, output correction control to make the output values from the respective density sensing sensors 55 for the same test patch (that has the same density with the same pattern) identical with one another is performed. Specifically, when the output values from the respective density sensing sensors 55 are corrected, density sensing output-correcting test patches corresponding to the respective density sensing sensors 55 are formed on the intermediate transfer belt 5. The correcting density sensing output-correcting test patches correspond to the respective density sensing sensors 55 have the same density with the same pattern. The corresponding respective density sensing sensors 55 read the density sensing output-correcting test patches corresponding thereto, and output the results (density of the test patch). Then, based on the outputs from the respective density sensing sensors 55, correction control for correcting the output value from any one of the density sensing sensors 55 is performed.

Figure 8:
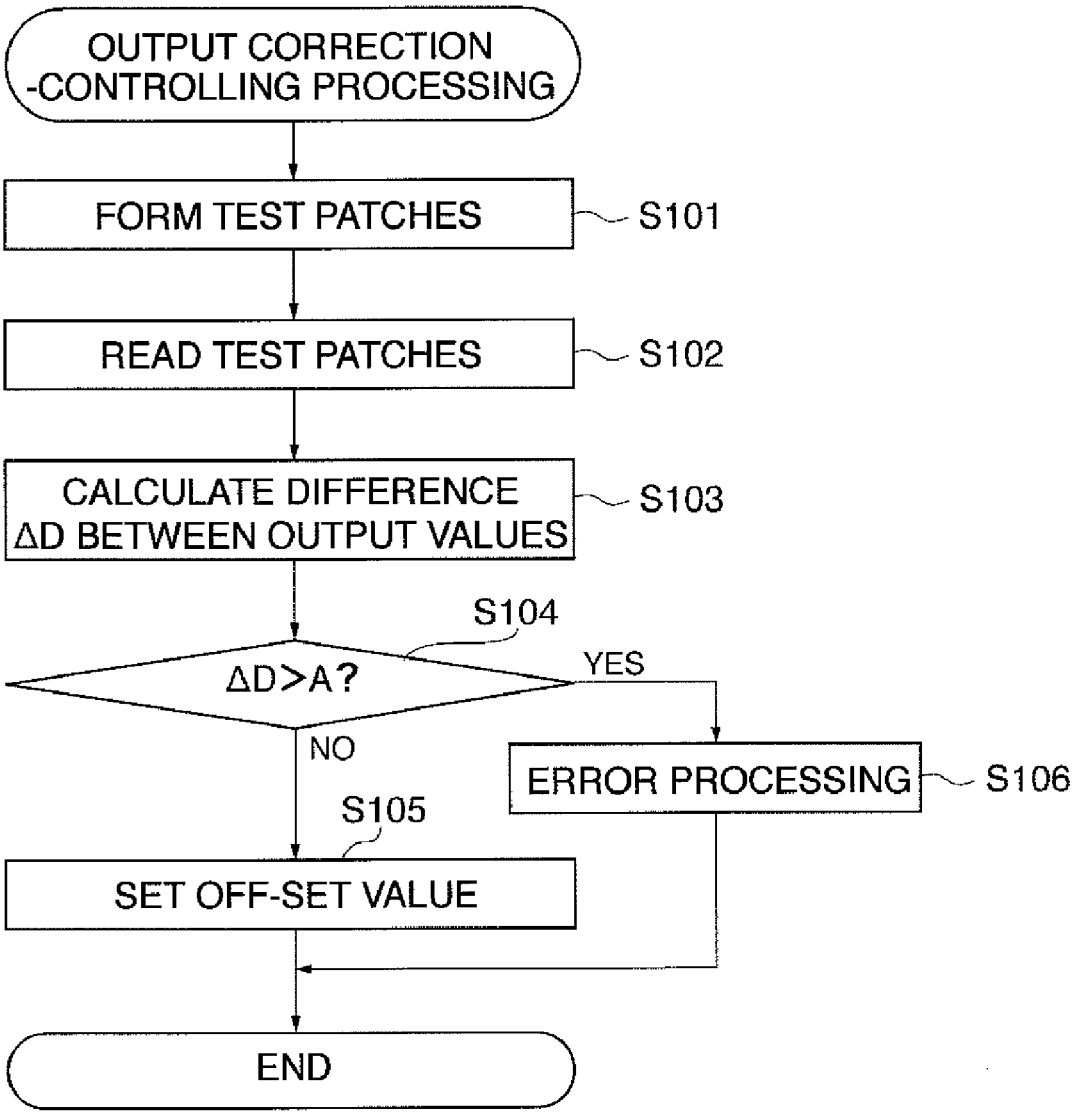
FIG. 8 is a flowchart showing the procedure of output correction-controlling processing for correcting output from each density sensing sensor in FIG. 1.

Next, processing for output correction-controlling processing for correcting outputs from the respective density sensing sensors 55 will be described with reference to FIG. 8. FIG. 8 is a flowchart showing the procedure of output correction-controlling processing for correcting output from the respective density sensing sensors 55. The output correction-controlling processing is performed under the control of the reader controller 700.

As shown in FIG. 8, when the outputs from the respective density sensing sensors 55 are corrected, an image signal of the correcting density sensing output-correcting test patch is formed on the RAM 706 from the reader controller 700, and instructions are given to the image processing unit 203 and the printer controller 701 to create an image of the density sensing output-correcting test patch on the intermediate transfer member 5 (step S101. Accordingly, the image signal of the density sensing output-correcting test patch is input from the image processing unit 203 to the printer controller 701. The printer controller 701 creates an image of the density sensing output-controlling test patches corresponding to the respective density sensing sensors 55 based on the input image signal on the intermediate transfer body 5. Here, a pair of the test patches arranged along the sub scanning direction at the same position with respect to the main scanning direction.

Next, the printer controller 701 controls the respective density sensing sensors 55 corresponding to the test patches transferred on the intermediate transfer belt 5 to read the test patches (step S102). That is, the light-emitting units 55*a* of the respective density sensing sensors 55 emit lights, and the photoreceptor units 55*b* receive the reflected lights from the test patches. Then, the outputs from the respective density sensing sensors 55 are input into the image processing unit 203 via the printer controller 701.

Next, the image processing unit 203 calculates a difference "ΔD" between the output values from one of the density sensing sensors 55 and the output value from the other of the density sensing sensors 55 (step S103). Then, the image processing unit 203 determines whether the calculated difference "ΔD" is bigger than a predetermined value A or not (step S104). If the difference value "ΔD" is not bigger than the predetermined value A, i.e., at the predetermined value A or less, the image processing unit 203 sets the difference "ΔD" as an off-set value for the output value from one of the density sensing sensors 55 (step S105), followed by terminating the processing.

In contrast, if it is determined that the difference "ΔD" is bigger than a predetermined value A at step S104, the image processing unit 203 determines that any one of the density sensing sensors 55 has broken down and reports the reader controller 700 as such (step S106), followed by terminating the control. Then, the control ends. The reader controller 701 that has received the report performs error reports while displaying, on the display unit 369 of the operation unit 707, any one of the density sensing sensors 55 having broken down, and controls the entire device to stop.

As such, according to the embodiment, the output values from the respective density sensing sensors 55 for the test patches with the same density are corrected to be identical with each other even if the sensitivity characteristics of respective density sensing sensors 55 vary according to an environmental state and a change with time. Accordingly, the sensitivity characteristics of respective density sensing sensors 55 can be kept almost identical with each other and a quality image can be provided in a stable manner without lowering the productivity.

In the embodiment, a difference between the output value of one of the density sensing sensors 55 and the output value of the other of the density sensing sensors 55 is assumed as an off-set value for the output value of the one of the density sensing sensors 55. Alternatively, for example, the difference "ΔD" is divided into two and +0.5 "ΔD" and −0.5 "ΔD" may be set as off-set values for the respective density sensing sensors 55, instead.

Figure 9:
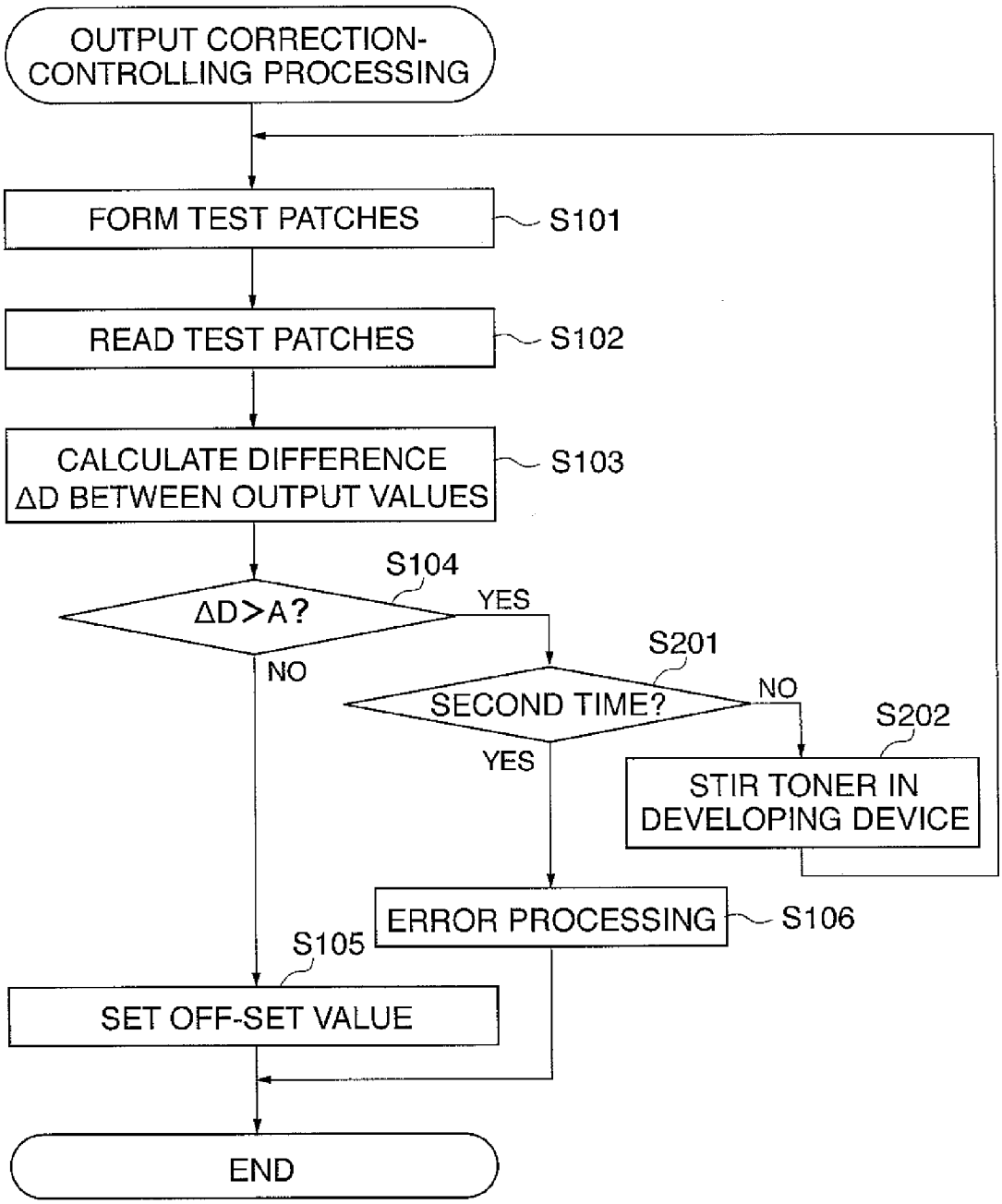
FIG. 9 is a flowchart showing the procedure of output correction-controlling processing for correcting output from the density sensing sensor in an image forming apparatus according to a second embodiment of the present invention.

Now, a second embodiment of the present invention will be described with reference to FIG. 9. FIG. 9 is a flowchart showing the procedure of output correction-controlling processing for correcting outputs from the respective density sensing sensor 55 in an image forming apparatus according to a second embodiment of the present invention.

In the first embodiment, if a difference between the output value of the one of the density sensing sensors 55 and the output value of the other of the density sensing sensors 55 exceeds a predetermined value, it can be considered that any one of the density sensing sensors 55 has broken down. As a reason for the difference exceeding the predetermined value other than the above-mentioned one, the electrostatic charge amount of the toner in the developing device is uneven at the forefront and the back of the developing device. That is, there is a difference between the electrostatic charge amount of the toner for developing the test patch corresponding to one of the density sensing sensors 55 and the electrostatic charge amount of the toner for developing the test patch corresponding to the other of the density sensing sensors 55. The difference in the electrostatic charge amounts causes a difference in density between the test patches corresponding to the respective density sensing sensors 55. The difference in density may be thought as a cause for the difference exceeding the predetermined value.

Then, in the embodiment, if a difference "ΔD" between the output value of the one of the density sensing sensors 55 and the output value of the other of the density sensing sensors 55 is bigger than the predetermined value A, first, an operation for making the electro static amount in the developing device is performed. After the operation, images of a pair of the density sensing output-correcting test patches are created again and the respective density sensing sensors 55 read the corresponding test patches. If the difference "ΔD" between the output value of the one of the density sensing sensors 55 and the output value of the other of the density sensing sensors 55 is bigger than the predetermined value A, it is determined that any one of the density sensing sensors 55 has broken down and the display unit 369 of the operation unit 707 displays as such. Then the entire device stops.

Output correction-controlling processing for the density sensing sensors 55 will be described with reference to FIG. 9. In this embodiment, only those different from the first embodiment will be described. The same reference numerals are given to the same steps as those in the first embodiment.

In the embodiment, if it is determined that the difference "ΔD" is bigger than the predetermined value "A" at step S104, the image processing unit 203 determines whether or not the determination that the difference "ΔD" is bigger than the predetermined value "A" is a second determination (step S201) as shown in FIG. 9. If the determination that the difference "ΔD" is bigger than the predetermined value "A" is not a second determination, it is determined that the electrostatic charge amount in the developing device is uneven. Then the printer controller 701 drives the stirring roller 402 in the developing device and the toner in the developing device is stirred (step S202). With this stirring, the electrostatic charge amount of the toner in the developing device is made even. That is, the electrostatic charge amount of the toner is made even at the forefront and the back of the developing device.

Thereafter, image creation of the test patch (step Sl0l), reading of the test patch (step S102), and calculation of the difference "ΔD" between the output values of the respective density sensing sensors 55 (step S103) are performed again. If the difference "ΔD" is bigger than the predetermined value "A" and the determination that the difference "ΔD" is bigger than the predetermined value "A" is the second determination (steps S104, S201), it is determined that it is not resulted from unevenness of the electrostatic charge amount in the developing device but resulted from a failure of any one of the density sensing sensors 55. Then, the image processing section 203 reports the reader controller 700 as such, performs error processing (step S106), followed by terminating the processing. The reader controller 700 that has received the report displays, on the display unit 369 of the operation unit 707, any one of the density sensing sensors 55 having broken down, and controls the entire device to stop.

In contrast, image creation of the test patch (step S101), reading of the test patch (step S102), and calculation of the difference "ΔD" between the output values of the respective density sensing sensors 55 (step S103) are performed again, and the difference "ΔD" may be at the predetermined value "A" or less. That means that the electrostatic charge amount of the toner in the developing device is made even at the forefront and the back of the developing device by stirring the toner in the developing device (step S202). Thus, it is determined that the respective density sensing sensors 55 are normal. Then, the difference "ΔD" is set as an off-set value against the output value from the one of the density sensing sensors 55 (step S105).

According to the embodiment, unevenness of the electrostatic charge amount of the toner in the developing device is considered to make the difference "ΔD" bigger than the predetermined A. Thus, a normal density sensing sensor is not prompted to be exchanged.

The embodiment is described as a density sensing sensor, although a registration sensor for performing color registration control may be subjected to the same detecting control.

In the embodiment, any one of the density sensing sensors 55 having been failed is displayed on the display unit 369 of the operation unit 707 and the entire device is controlled to stop. However, if only one of the density sensing sensors has failed, it may be controlled to keep using the device by using the other of the density sensing sensors that is not failed.

While the present invention has been described with reference to exemplary embodiments, it is to be understood that the invention is not limited to the disclosed the embodiments. The scope of the following claims is to be accorded the broadest interpretation so as to encompass all such modifications and equivalent structures and functions.

This application claims the benefit of Japanese Patent Application No. 2006-189620, filed Jul. 10, 2006 which is hereby incorporated by reference herein in its entirety.

What is claimed is:

1. An image forming apparatus comprising:

an image carrier;

an image forming unit adapted to form a reference image on said image carrier;

a first sensing unit disposed opposite to said image carrier at a first position;

a second sensing unit disposed opposite to said image carrier at a second position different from the first position; and a control unit adapted to adjust an output of said second sensing unit if a level difference between an output of said first sensing unit and the output of said second sensing unit is not bigger than a predetermined value, and adapted to report that either said first sensing unit or said second sensing unit has broken down if the level difference is bigger than the predetermined value, when said first sensing unit and said second sensing unit sense the reference image formed on said image carrier.

2. The image forming apparatus according to claim 1, further comprising:

a developing unit adapted to contain a developing solution and supply the developing solution to said image forming unit; and a stirring unit adapted to stir the developing solution in said developing unit, wherein said control unit causes said stirring unit to stir the developing solution in said developing unit, and then causes said image forming unit to again form the reference image, and further reports that either said first sensing unit or said second sensing unit has broken down if the level difference is bigger than the predetermined value, when said first sensing unit and said sensing unit sense the again formed reference image.

3. The image forming apparatus according to claim 1, wherein said control unit causes said image forming unit to form said reference image when said control unit adjusts the output from said second sensing unit.

* * * * *